United States Patent [19]

Siegenthaler

[11] Patent Number: 4,730,715

[45] Date of Patent: Mar. 15, 1988

[54] EXCHANGEABLE COIN COLLECTION BOX FOR COIN-OPERATED AUTOMAT

[75] Inventor: Fritz Siegenthaler, Trub, Switzerland

[73] Assignee: Autelca AG., Gümligen, Switzerland

[21] Appl. No.: 889,498

[22] Filed: Jul. 25, 1986

[30] Foreign Application Priority Data

Aug. 22, 1985 [CH] Switzerland ..... 3619/85

[51] Int. Cl.[4] ..... G07F 9/06

[52] U.S. Cl. ..... 194/351; 232/15

[58] Field of Search ..... 232/15, 16; 194/350, 194/351

[56] References Cited

U.S. PATENT DOCUMENTS

| | | | |
|---|---|---|---|
| 2,580,752 | 1/1952 | Forester | 232/15 |
| 3,353,743 | 11/1967 | Amundsen | 232/15 |
| 3,428,216 | 2/1969 | Bolen | 194/351 X |
| 3,433,185 | 3/1969 | Roberts | 232/15 X |
| 3,948,376 | 4/1976 | Roman | 194/350 X |
| 4,638,746 | 1/1987 | Ishigure | 232/15 X |

FOREIGN PATENT DOCUMENTS

| | | | |
|---|---|---|---|
| 2130299 | 5/1984 | United Kingdom | 194/351 |

*Primary Examiner*—F. J. Bartuska

*Attorney, Agent, or Firm*—Brady, O'Boyle & Gates

[57] ABSTRACT

A coin feed opening (16) formed in the lid (1) of the coin collection box is associated with a closure with a closing slide (17) displaceble by means of a moving mechanism (49, 45, 46) operable on the outside of the coin collection box. An escapement (29–32) designed as a jump mechanism makes possible, after every closing of a lock (6) securing the lid (1) against unauthorized opening, only a one-time opening and subsequent closing of the closure. Once the coin collection box is in the automat in its predetermined position, a catch (57, 59) blocking the closure in the opening direction (28) is released by a bolt (53) fixedly connected to the automat. At the same time, the bolt (53) is locked by means of a latch (58) in the coin collection box when the closing slide (17) is in the open position.

4 Claims, 3 Drawing Figures

EXCHANGEABLE COIN COLLECTION BOX FOR COIN-OPERATED AUTOMAT

The invention relates to a coin-operated automat with coin collection boxes which are exchangeable and are provided with a coin feed slot. The automat can be for example, an automatic vending machine or a service automat, for example a pay telephone or a coin changer.

BACKGROUND OF THE INVENTION

In such automats, the coin collection boxes containing the coins taken in by the automat are regularly replaced by empty coin collection boxes and brought to a collection point. There, they are opened up and, after removal of the coins, reclosed to be reinserted in the automats in place of coin collection boxes wherein coins have accumulated. Only the personnel at the collection site have keys available for a lock securing the coin collection boxes against unauthorized opening whereas the personnel transporting the coin collection boxes between the collection point and the automats do not have such keys available.

As experience has shown, attempts are made during transporting and exchanging of the coin collection boxes to improperly obtain coins collected by the automat; for example, efforts have been made to remove coins from the locked coin collection boxes or to make such removal possible by preparatory manipulations carried out on the empty coin collection boxes or by actions taken during the exchanging of the boxes.

In case of automats equipped with counters for the collected coins or for the services rendered, it is possible to clearly determine subsequently a coin shortage, if necessary after testing the operation of the counters, but the shortage cannot be prevented. If the meter count is read, as is customary, respectively by the person who exchanges the coin collection boxes, and such count is recorded in each case falsely, namely after accounting for the number of coins stolen, by the person exchanging the boxes or also at the collection point, then the thefts can remain unnoticed for a relatively long period of time.

SUMMARY OF THE INVENTION

The invention addresses itself to seeking a corresponding remedy. The invention solves the problem of providing an automat of the type discussed hereinabove with coin collection boxes reliably preventing unauthorized removal of coins and rendering unsuccessful any possible interventions that may be made to accomplish such purpose.

The latch mechanism has the effect, together with the catch, that the closure is open only at the time the coin collection box is in its position in the automat destined for coin collection, but otherwise is sealed at all times and, in this condition, cannot be opened, either, so that coins cannot be removed in an unauthorized fashion. Since the coin feed opening, in this position of the coin collection box in the automat, though it can be opened, is inaccessible and is otherwise sealed, it is not possible, either, to intervene through the coin feed opening with the closure, the catch and/or the escapement, for example to influence their cooperation with the latch mechanism for the purpose of achieving a subsequent, improper coin removal.

The latch mechanism requires cooperation with an element of the automat. The possibility cannot be excluded that an attempt may be made to simulate the action of this element, with the coin collection box located outside of the automat, so that the catch is released and the closure can be opened for unauthorized coin removal or for the purpose of an intervention.

Such actions meet with failure if the escapement is provided instead of or in addition to the catch. This feature has the result that the closure cannot be opened once again after it had to be opened for coin acceptance and then had to be reclosed to make it possible to remove the coin collection box from the automat. The closure can be reopened only after the coin collection box has been opened for authorized coin removal at the collection site and has been reclosed.

However, the escapement does not prevent opening of the closure before inserting the coin collection box in the automat (if the catch is not additionally included). The latch mechanism, though, can be designed so that the coin collection box, when the closure is open, cannot be placed into its predetermined position in the automat. Therefore, the closure will have to be closed again for making it possible to insert the coin collection box in the automat, and then the closure can no longer be opened for coin acceptance by the box. The premature opening of the closure can have been the purpose for an intervention or can have been an operating error. This leads to a disturbance in the operating sequence of exchanging the coin collection boxes because the coin collection box with the erroneously operated closure must be brought back to the collection point without having received any coins, must be opened, and must be reclosed at that point in order to be again ready for use.

By equipping the coin collection boxes with the catch as well as with the escapement, the interventions mentioned in connection with the former as well as the latter, and the erroneous operation, are precluded. The possibilities for such interventions also depend on the type of design of the automat and of the coin collection boxes. The probability of interventions and of erroneous operation vary in dependence on the personnel situation. The coin collection boxes will be designed to have the catch and/or the escapement in correspondence therewith.

The advantages achieved by the invention are to be seen essentially in that unauthorized withdrawal of coins from the coin collection boxes and all interventions with the coin collection boxes imaginable for this purpose are prevented, unless destructive force is employed which latter step can be prevented by technical measures to an only limited extent.

Special embodiments of the invention prevent, inter alia, not only unauthorized removal of coins from the coin collection boxes and any interventions with the coin collection boxes imaginable for this purpose, but moreover absolutely preclude unauthorized access to coins collected by the automat, in that the automat is capable of operating only in case a coin collection box has been inserted in the automat in its position meant for coin collecting, and its coin feed opening is open, or, respectively, is capable of operation only in case each collected coin passes into the coin collection box. In this connection, it is impossible to operate the automat without a coin collection box in order to seize the coins that have dropped into the space intended for the box, or to jam the outlet of the coin duct of the automat, leading to the coin inlet opening of the coin collection box in case of proper insertion of the latter, by means of a foreign body and to remove this foreign body later on for taking the coins that have accumulated in this duct in the meantime. An additional development of the invention permits monitoring whether a coin collection box inserted in the automat is intended for operating in conjunction with this automat. Additional embodiments of the invention, solutions of individual problems, and advantages can be derived from the description set forth below in connection with the drawings.

BRIEF DESCRIPTION OF THE DRAWINGS

The invention will be described in greater detail below with reference to drawings which illustrate merely one way of performing the invention. In the drawings.

DESCRIPTION OF THE PREFERRED EMBODIMENT

Figure 1:
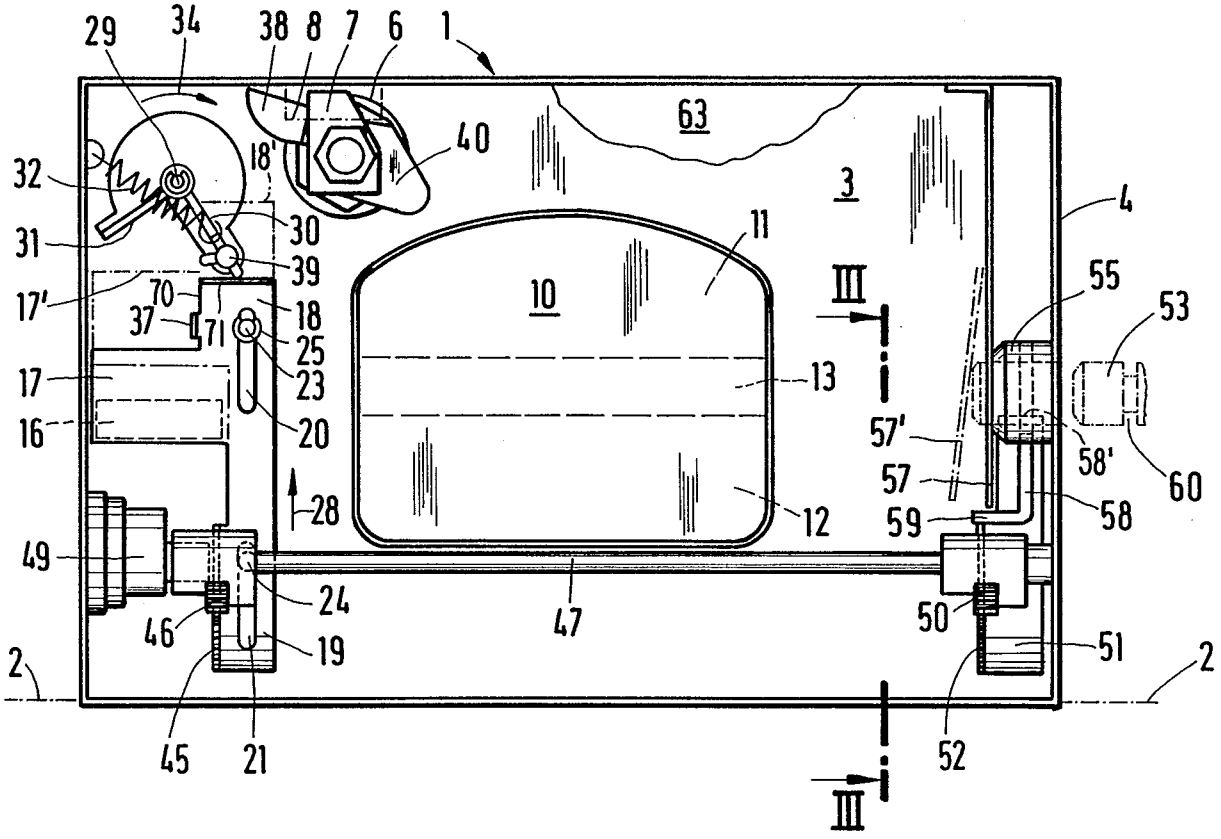
FIG. 1 shows a bottom view of the lid of an exchangeable coin collection box pertaining to a coinoperated automat wherein movable parts are illustrated in the position after the opening and subsequent closing of a lock securing the coin collection box against unauthorized opening.

The lid 1, shown in FIG. 1 and pertaining to the (not otherwise illustrated) coin collection box (called, in brief, coin box hereinbelow), is a hinged lid turnable about a hinge axis 2 and consisting of a lid plate 3 and a rim 4 projecting downwardly at the lid plate 3 in the closed position of the lid 1, thereby adjoining the upper rim of the peripheral walls, not shown, of the coin box. The lid 1 can be closed by a lock 6, designed as a cylinder lock, the cylinder of which, not shown, is connected to a lock bolt 7; the latter, in the locking position, extends underneath a closing plate 8 of the coin box, which plate is mounted at the top on the inside of one of the sidewalls of the coin box. A grasping trough 10 is disposed on the inside of the lid plate 3 for a carrying handle 13 formed in the lid plate 3 between two recesses 11 and 12.

The plate 3 is provided with a coin feed opening 16 closable by a closing slide 17. The closing slide 17 has two guide extensions 18 and 19 with slotted holes 20 and 21 engaged by guide pins 23 and 24, each of the latter being studded with a circlip 25 in order to guide the slide 17 closely against the lid plate 3 in sliding displacement. Beside the lock 6, an escapement designed as a jump mechanism or bistable toggle mechanism 29–32 is arranged in the opening direction 28 of the closing slide 17 in front of the guide extension 18 of the latter.

The jump or bistable toggle mechanism 29–32 comprises an angle lever 30, 31 rotatably mounted about an axle 29, this lever being under the action of a tension spring 32. This tension spring, in a first condition of the jump mechanism 29–32 shown in FIG. 1, lies on one side of the axial line of the axle 29, exerting a torque on the angle lever 30, 31 in direction 34, and, in the other, second condition of the jump mechanism 29–32 shown in FIG. 2, lies on the other side of the axial line of axle 29, exerting a torque in the direction 35 on the angle lever 30, 31. In the first condition, the lever arm 30 is urged against the end 71 of the slide extension 18 so that it is entrained during the opening movement (arrow 28) of the closing slide 17. During this step, the tension of spring 32 increases. Once the closing slide 17 and slide extension 18 has reached its open position 17; 18' shown in dot-dash lines in FIG. 1 (or shortly before), the spring 32 changes from one side of the axial line of axle 29 to the opposite side, and the jump mechanism 29–32 changes, jump-like or toggle like, from the first condition (FIG. 1) to the second condition (FIG. 2). The other lever arm is constituted by a pawl 31 which is urged, in the second condition of the jump mechanism 29–32, against one side 70 of the guide extension 18 of the closing slide 17. On this side of the slide extension 18, a stop 37 is provided which is engaged by the pawl 31, the latter blocking the closing slide 17 in the opening direction once the slide has been pushed from its open position 17', shown in dot-dash lines, into its closed position 17, shown in solid lines, as illustrated in FIG. 2. This blockage of the slide 17 against an opening movement 28 is released when the lock 6 is opened. During this step, a cam 38, fixedly connected to the lock cylinder or the lock bolt 7, entrains a peg 39 mounted to the free end of the lever arm 30 until the jump mechanism 29–32 changes over jump-like from its second condition (FIG. 2) into its first condition (FIG. 1). In order to prevent rotation of the cam 38 too far beyond the position wherein it triggers the change in condition of the jump mechanism 29–32, the opening movement of the lock 6 is restricted by a stop 40 (FIG. 1) cooperating with the lid rim 4.

A first rack-and-pinion gear 45, 46 serves for shifting the closing slide 17—when the latter is not blocked by the pawl 31 or by the catch mechanism 57, 59 described hereinbelow—the rack 45, formed at the slide extension 19 and pertaining to this rack-and-pinion gear, meshing with a gear segment 46 seated on a shaft 47. The shaft can be rotated on the outside of the lid rim 4, in the illustrated embodiment by means of a second cylinder lock 49, the key of which can be inserted on the outside of the lid rim 4.

A second gear segment 50 is seated on the shaft 47 and meshes with a second rack 52, formed at a slide 51 and pertaining to a second rack-and-pinion gear 50, 52. In this way, the slide 51 can be displaced only together with the closing slide 17. The slide 51 belongs to a catch and latch mechanism 57, 59 and 53, 58, 60. The catch mechanism 57, 59 blocks the closing slide 17 in the opening direction 28 as long as the coin box is not in its position in the automat serving for acceptance of coins. The latch mechanism 53, 58, 60 locks the coin box in this position in the automat as long as the closing slide 17 is in the open position 17'.

For this purpose, a bolt 53 is arranged in the space of the automat receiving the coin box, this bolt extending, with the coin box being properly inserted in the automat, through a sleeve 55 arranged behind a hole of the lid rim 4. The slide 51 is firmly connected to a latch 58 associated with a groove 60 of the bolt 53. In the closed postiion of the closing slide 17, a stop 59 of the latch 58 is lcoated in front of the free end of a leaf spring 57 and prevents an opening movement of the closing slide 17 at the time the leaf spring 57 is in contact with the sleeve. Once the coin box is in its predestined position in the automat, the bolt 53 deflects the leaf spring 57 into the position 57' shown in dot-dash lines in FIG. 1 and retains the spring beside the stop 59. With the opening movement of the closing slide 17, now made possible, the latch 58 is advanced, by the rotation of the second gear segment 50, into a position 58 wherein it projects into the sleeve 55 and engages into the groove 60 of the bolt 53 whereby the latter is locked in the sleeve 55, and the coin box can be removed from the automat only after the closing slide 17 has been moved back into its closed position and thereby the latch mechanism 53, 85, 60 has been released.

The outlet of the coin duct (not shown) of the automat is arranged in the space of the automat accommodating the coin box in such a way that this outlet immediately adjoins the coin inlet opening 16 of the coin box once the latter has been inserted in the automat in the position intended therefor. For example, a coin outlet opening can be arranged on a wall of this space along which the lid plate 3 of the lid 1 slides while the coin box is pushed into its predetermined position in this space.

Figure 2:
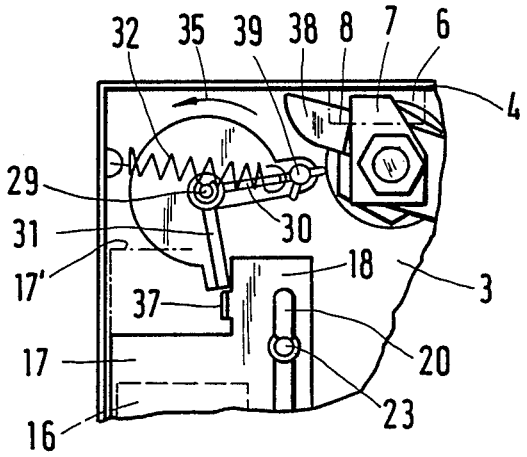
FIG. 2 shows a fragmentary view of FIG. 1 wherein movable parts are illustrated in the position after opening and subsequently closing the closure of the coin feed opening of the coin collection box.
Figure 3:
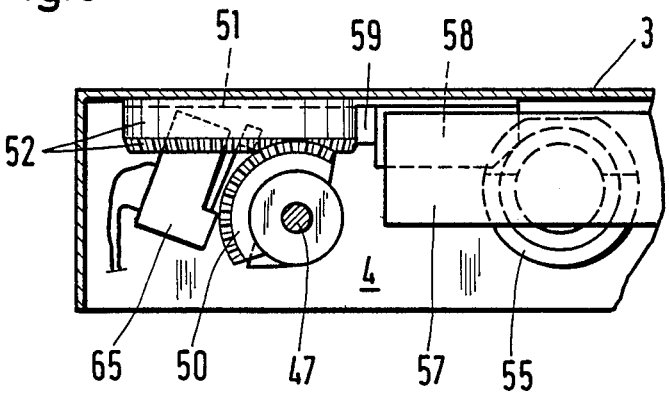
FIG. 3 shows a partial section III—III of FIG. 1 on a somewhat larger scale, in the locked condition of the lid with the closure being closed.

Once the coin box has been opened at the collection point authorized to withdraw the coins and (after removal of the coins) has been reclosed and secured by the lock 6 against unauthorized opening, the movable parts are in their position illustrated in solid lines in FIG. 1. The closing slide 17 is in the locked position, the jump mechanism 29–32 is in its first condition, and the cam 38 is outside of the travel route of the closing slide extension 18. The catch mechanism 57, 59 is in the blocking condition wherein it prevents opening of the closing slide 17. The latch 58 is retracted into is inactive condition.

Only after the coin box has been inserted in the automat in its predetermined position does the bolt 53 deflect the leaf spring 57, whereupon the closure can be opened, i.e. the closing slide 17 can be shifted to open the coin feed opening. During this step, the jump mechanism 29–32 changes over into its second condition, and the latch 58 engages into the groove 60 of the bolt 53. Thereby, the coin box is undetachably held in the automat as long as the closure is open. Before the coin box that has received coins accepted by the automat can be removed from the automat, the closure must again be closed, the closing slide 17 must thus be shifted against the direction of arrow 28, during which step the latch 58 is pulled back from its locking position, and the pawl 31 of the jump mechanism 29–32 engages at the stop 37 and blocks the closing slide 17 in the opening direction 28 (FIG. 2). At this point in time, it is no longer possible to open the closure in order to obtain coins from the cassette, and—because the jump mechanism 29–32 is in the second condition (FIG. 2)—this is impossible even if a peg-like tool simulating the bolt 53 were to be introduced, for example, through the sleeve 55 in order to release the blocking means 57, 59. Only when the coin box is opened at the collection point will the cam 38 engage at the pin 39 and restore the jump mechanism 29–32 to its first condition (FIG. 1) wherein the closure can be opened only once the (empty) coin box has been reinserted in an automat. The jump mechanism could also be brought into the first condition by the pivoting motion of the lid 1, instead of by the rotation of the cylinder of lock 6; also, it is unimportant whether this result is obtained by the opening or closing of the lock 6 or, respectively, the lid 1.

Not only the attempt of obtaining an opening of the closure after removal of the coin-containing coin box from the automat by improper release of the catch mechanism 57, 59, but also the attempt of somehow manipulating the locking mechanism prior to insertion of the empty coin box in the automat to obtain subsequent opening of the closure, will be unsuccessful. If the catch mechanism 57, 59 of the empty coin box is released by an intervention before introduction into the automat, then the closure can actually be opened, but the coin box cannot be inserted, with the closure being open, in its position in the automat intended for coin reception because the latch 58 projects in this case into the cavity of the sleeve 55, thus precluding insertion of the bolt 53 in the sleeve 55. It would thus serve no purpose to block the closure slide 17 in the open position. If a successful attempt were made to obtain access, in the open position of the closing slide 17, to the jump mechanism 29–32 through the coin feed opening 16, the jump mechanism—in order to provide a repeated opening—could not be placed into its first condition, since this would be possible only in the closing position of the closing slide 17, it being impossible to reach through the coin feed opening 16. Of course, to prevent such interventions and especially damage that could be caused thereby, protective walls could additionally be provided, or a coin inlet duct could be arranged in alignment with the coin feed opening 16 on the side of the closing slide 17 lying in opposition to the feed opening.

The aforedescribed mechanisms are protected from actions of abuse by an only partially illustrated cover 63 connected to the lid rim 4 in such a way that it cannot be improperly detached. If the just mentioned coin inlet duct is included, the latter terminates at an opening of the cover 63 adapted to the duct, or the duct extends through such opening. In this arrangement, it is impossible to reach into the interspace between the lid plate 3 and the cover 63, either through the coin feed opening 16 or through this opening of the cover 63.

A switch 65 is disposed beside the second gear segment 50 and can be actuated by a cam, not shown, fixedly connected with this gear segment so that the switch is open in the open position of the closing slide 17 and closed in the closed position of the latter, or vice versa. The switch 65 is connected to the control circuit of the automat once the coin box is in its predetermined position in the automat and serves for rendering the automat operable only when the closing slide 17 is in its open position. It is furthermore possible to arrange a light barrier or a sensor on the side of the closure slide 17 facing away from the coin inlet opening 16 or at the aforementioned coin inlet duct (not shown), this light barrier or sensor responding to each coin passing into the coin box and being connected to the control circuit of the automat when the coin box is in its predetermined position in the automat. In this arrangement, the control circuit prevents operation of the automat when the light barrier or the sensor does not respond every time the automat has accepted a coin. Furthermore, an electrically readable storage unit can be located in the coin box for a code sign associated with the coin box or several mutually exchangeable coin boxes, this storage unit being likewise connected with the control circuit of the automat once the coin box is inserted in its predetermined position in the automat. The control circuit reads the code sign, for example to permit operation of the automat only with coin boxes intended therefor. For connection of the switch 65, the light barrier or sensor, and the storage unit to the control circuit, it is advantageous to provide one of the components of the plug-in or push-in connectors on the side of the coin box where the member 53 can be introduced, and the other components at the wall of the space for accommodating the coin box in the automat, which wall is in contact with this side of the coin box once it is in its predetermined position in the automat, i.e. the wall where the element 53 projects.

I claim:

1. An exchangeable coin collection box for coin-operated automats, comprising a wall (1) on the coin collection box having a coin feed opening (16) for receiving coins from the automat;

closure means (17) for said coin feed opening (16) having a first position (17) in which said coin feed opening (16) is closed, and second position (17') in which said coin feed opening (16) is open;

take-up means (55) adapted to receive a member (53) undetachably provided in the automat, when the box is inserted therein for receiving coins at said coin feed opening (16);

latch means (58) arranged on said take-up means (55) and having an inoperative first position (58) and a second position (58') adapted to prevent said take-up means (55) from receiving the member (53) and adapted to secure the member (53) in said take-up means (55) when received therein with said latch means (58) in said first position;

moving means (49, 46, 45, 50, 52) and coupling means (47) for collectively moving said closure means (I7) and said latch means (58) from their first (17, 58) to their second positions (17', 58') and vice versa;

catch means (57) resiliently mounted on said take-up means (55) in a rest position (57) blocking said closure means (17) and said latch means (58) against movement from their first (17, 58) to their second positions (17', 58'), and adapted to be deflected to an inoperative position (57') by the member (53) when it (53) is received by said take-up means (55).

2. An exchangeable coin collection box as claimed in claim 1, including a cover (63) connected on said lid that cannot be improperly detached therefrom, completely enclosing said closure means (17), take-up means (55), latch means (58), moving means (49, 46, 45, 50, 52) and coupling means (47), and catch means (57) in the box.

3. An exchangeable coin collection box as claimed in claim 1, further including a spring loaded bistable toggle means (29–32) having a first state (FIG. 1) spring loaded in a first direction (34), and a second state (FIG. 2) spring loaded in a second direction (35) opposite to said first direction (34), said bistable toggle means operable from said first state (FIG. 1) to said second state (FIG. 2) by moving said closure means and said latch means from their first (17, 58) to their second positions (17', 58'), said bistable toggle means operative in its second state (FIG. 2) to block said closure means and said latch means in their first positions (17, 58) against movement to their second positions (17', 58'), a lid (1) connected to be opened for removal of the coins from the box, a lock (6) for securing said lid in its closed position, and a cam (38) rotable by actuation of said lock (6), for moving said bistable toggle means (29–32) from its second (FIG. 2) to its first state (FIG. 1).

4. An exchangeable coin collection box as claimed in claim 3, wherein said bistable toggle means (29–32) including an angle lever having a first lever arm (30) and a second lever arm (31);

an axle (29) rotatably mounting said angle lever (30, 31) on said wall (1);

a tension spring (32) having one end thereof stationary fixed and the other end connected to said angle lever (30, 31) for urging it (30, 31) alternatively in a first (34, FIG. 1) and a second direction (35, FIG. 2) opposed to each other;

an element (18) collectively movable together with said closure means (17) and said latch means (58) by said moving means (49, 46, 45, 47, 50, 51) between a first (18) and second position (18') corresponding to said first and second position respectively of said closure means (17) and said latch means (58);

said element (18) having a side face (70) extending in the direction of its (18) movement (28), and an end face (71) facing said angle lever (30, 31), and a stop member (37) provided on said side face (70);

with said element (18) in its first position and said angle lever (30, 31) in its second state (35, FIG. 2) said second lever arm (31) is urged against said side face (70) of said element (18) for cooperation with said stop member (37) to block movement of said element (18) from its first position (FIG. 2) to its second position (FIG. 1), while said second lever arm (31) is operable by said cam (38) of said lock (6) for moving said angle lever (30, 31) to its first state (FIG. 1) with said first lever arm (30) urged against said end face (71) of said element (18), and said second lever arm (31) disengaged therefrom (18) so that said element (18) is movable to its second position (18') thereby moving said angle lever (30, 31) to its second state (FIG. 2) with said second lever arm (31) urged against said side face (70) of said element (18) overlapping said stop member (37) thereon, and, after moving said element to its first position (18) said second lever arm (31) again blocks movement of said element (18) to its second position (18').

* * * * *